US005232393A

United States Patent [19]

Brown

[11] Patent Number: 5,232,393

[45] Date of Patent: Aug. 3, 1993

[54] TOY TRAILER

[76] Inventor: Jerry H. Brown, 651 Crescent Dr., Gatlinburg, Tenn. 37738

[21] Appl. No.: 760,092

[22] Filed: Sep. 16, 1991

[51] Int. Cl.[5] ..... A63H 17/05

[52] U.S. Cl. ..... 446/434; 446/428

[58] Field of Search ..... 446/434, 427, 428; 280/425.2, 441.2

[56] References Cited

U.S. PATENT DOCUMENTS

| | | | |
|---|---|---|---|
| 2,201,910 | 5/1940 | Meienborn . | |
| 2,602,266 | 7/1952 | Preston . | |
| 2,717,707 | 9/1955 | Martin | 280/425.2 X |
| 2,854,162 | 9/1958 | Keir | 280/441.2 X |
| 2,872,059 | 2/1959 | Miller | 280/425.2 X |
| 3,883,019 | 5/1975 | Hansen, Jr. | 280/441.2 X |
| 4,513,987 | 4/1985 | Whitaker | 280/441.2 |

FOREIGN PATENT DOCUMENTS

| | | | |
|---|---|---|---|
| 1049164 | 11/1966 | United Kingdom | 446/434 |

*Primary Examiner*—Mickey Yu
*Attorney, Agent, or Firm*—Pitts & Brittian

[57] ABSTRACT

A toy trailer (10) for releasably engaging and being pulled behind a toy vehicle (24), and for being supported by and moved over a selected travel surface. The toy trailer (10) includes a bed portion (12) defining an upper cargo supporting surface (13), and defining a front end portion (20) provided with a pair of selectively spaced ramp sections (28 and 30). The bed portion (12) also defines a rear end portion (18) provided with at least a pair of oppositely disposed wheel members (16). A neck member (22) is included for releasably coupling the bed portion (12) with a toy truck or tractor (24). The neck member (22) has a front portion provided with member for releasably engaging the toy vehicle (46), and has a rear portion for pivotally and releasably engaging the front end portion (20) of the bed portion (12), whereby the front end portion (20) of the bed portion (12) can be selectively pivoted to engage the travel surface and the neck member (22) can be selectively disconnected from the front end portion (20) of the bed portion (12). Also, at least one stop member (50) is provided for selectively maintaining the bed portion (12) in a level position relative to the travel surface.

7 Claims, 4 Drawing Sheets

TOY TRAILER

TECHNICAL FIELD

This invention relates to a toy trailer for being releasably connected to a toy truck or tractor. In this particular invention the toy trailer is configured to depict a trailer commonly referred to as a "low boy" having a detachable trailer neck for engaging a truck or tractor.

BACKGROUND ART

Truck trailers commonly known as "low boy" trailers are known in the art. These trailers are releasably connected to a truck or tractor and include a flat bed portion which is particularly suited for carrying other vehicles. Certain "low boy" trailers feature loading ramps at the rear of the trailer to allow the vehicle to be carried to drive on to the trailer.

However, where the cargo comprises heavy equipment trailers which are commonly referred to as "drop neck low boy" trailers are preferred. These trailers feature the loading ramp at the front of the trailer, and hydraulic or other means for lowering the front portion of the trailer such that the outboard end of the ramp is at or proximate ground level. In order to provide access to the forwardly disposed loading ramp a "drop neck" trailer includes a removable neck members for connecting the trailer to a tractor. When the forward portion of the bed is lowered and the neck member is removed, the vehicle to be carried on the trailer can simply be driven up the ramp and onto the bed of the trailer.

Of course, trucks with trailers have long been popular toy. However, given the hydraulic and other complex actuating means which accomplish the lowering of the forward portion of the trailer bed and removal of the neck member, the "low boy break neck" trailer is not readily adaptable to a functional toy configuration.

Therefore, it is an object of the present invention to provide a toy trailer for being releasably connected to a toy truck or tractor which depicts, and simulates the functioning of, a "low boy break neck" trailer.

It is another object of the present invention to provide a toy trailer that can be operated by a child without adult assistance.

Yet another object of the present invention is to provide a toy truck which is inexpensive to manufacture.

Still another object of the present invention is to provide a toy trailer which is durable.

DISCLOSURE OF THE INVENTION

Other objects and advantages will be accomplished by the present invention which provides a toy trailer for releasably engaging and being pulled behind a toy truck or tractor over a selected travel surface. The toy trailer includes a bed portion defining an upper cargo supporting surface, and defining a front end portion defining a pair of selectively spaced ramp sections. The bed portion also defines a rear end portion provided with at least a pair of oppositely disposed wheel members. A neck member is included for releasably coupling the bed portion with a toy truck or tractor. The neck member has a front portion provided with means for releasably engaging the toy truck or tractor, and has a rear portion for pivotally and releasably engaging the front end portion of the bed portion, whereby the front end portion of the bed portion can be selectively pivoted to engage the travel surface and the neck member can be selectively disconnected from the front end portion of the bed portion. Also, at least one stop member is provided for selectively maintaining the bed portion of the trailer in a level position relative to the travel surface on which the trailer is supported.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
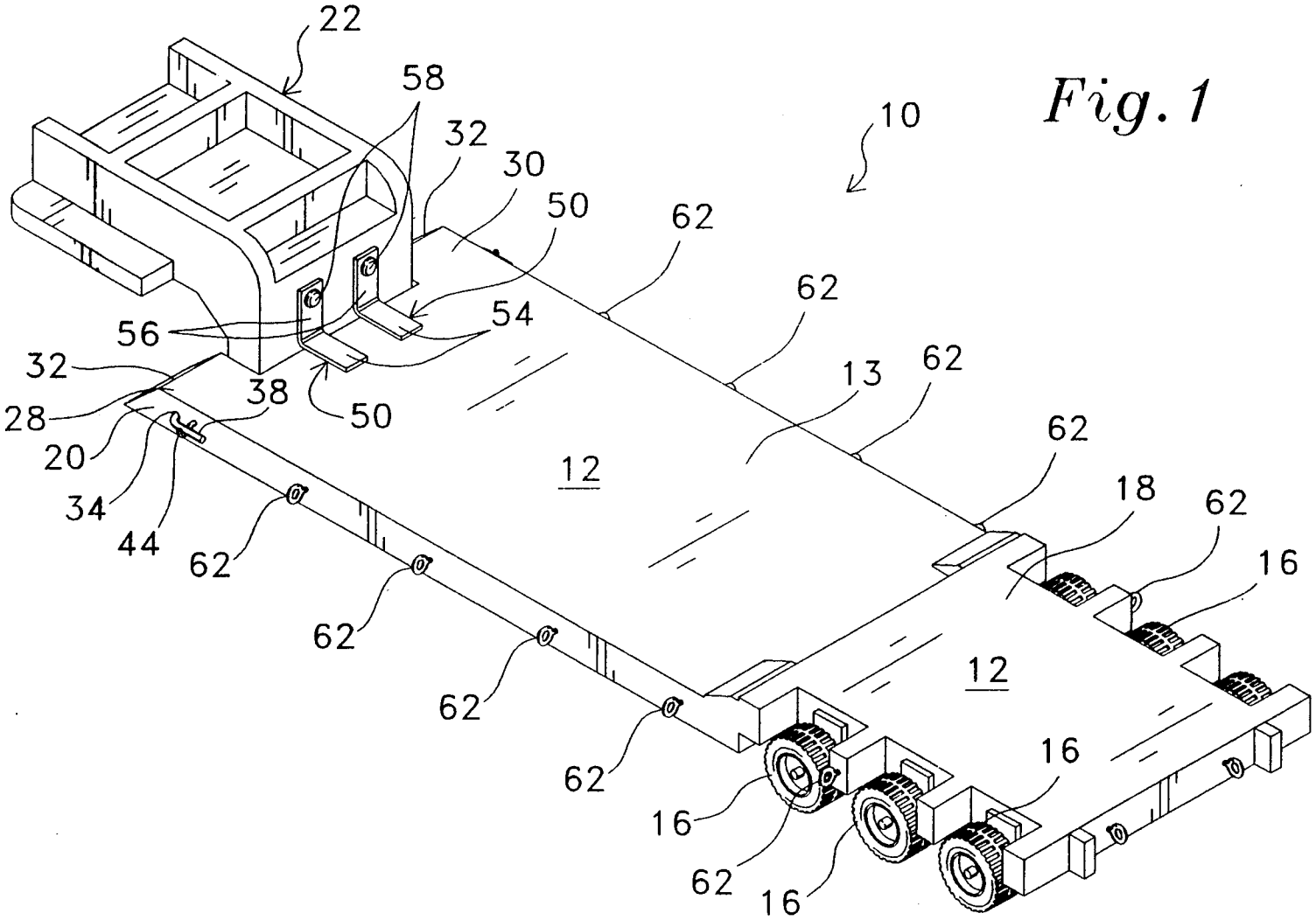
FIG. 1 illustrates a perspective view of a toy trailer of the present invention.

A toy trailer incorporating various features of the present invention is illustrated generally at 10 in the Figures. The trailer comprises a bed portion 12 (often referred to as the "float") having an upper cargo supporting surface 13 for supporting cargo, such as the toy vehicle illustrated at 14 in the Figures. A plurality of wheel members 16 are rotatably mounted at the rear end portion 18 of the bed portion 12 for movably supporting the rear end portion 18. In the preferred illustrated embodiment there are three wheel members 16 mounted on each side of the bed portion 12, but it will be understood that the number of wheel members 16 provided on each side can vary.

The trailer 10 also comprises a tractor coupling means, such as the illustrated neck member 22, for releasably coupling the bed portion 12 to a toy tractor 24 or the like. In this regard, a first coupling means is provided for securing the rearward portion of the neck member 22 to the front end portion 20 of the bed portion 12. More specifically, in the preferred embodiment the front end portion 20 of the bed portion 12 defines a pair of selectively spaced forwardly extending ramp sections 28 and 30 between which the rearward portion of the neck member 22 is selectively positioned. It will be recognized that the ramp sections 28 and 30 define inclined ramp surfaces 32 which facilitate the movement of a toy vehicle onto the load supporting surface 13.

In the preferred embodiment, each of the ramp sections 28 and 30 is provided with a substantially horizontally aligned hole 34 which registers with one of the holes 36 provided in the rearward portion of the neck member 22, as the neck member is positioned between the ramp sections 28 and 30. In order to secure the neck member 22 to the bed portion 12, a pair of securing pins 38 are provided which are received in the holes 34 of the ramp sections and in the registering holes 36 of the neck member 22, thereby pivotally securing the neck member 22 to the bed portion 12.

It will be noted that whereas two securing pins 38 are utilized in the preferred illustrated embodiment, it is contemplated that a single pin 38 could be used. This could be accomplished by providing a single hole 36 which extends through the neck member 22, and inserting a securing pin 38 which extends through one of the ramp sections and the neck member 22, and into the other ramp section.

In the preferred embodiment a locking means is provided to releasably lock the pins 38 in position such that they do not inadvertently become dislodged during use of the toy trailer. In this regard, in the illustrated embodiment each of the securing pins 38 is L-shaped so as to define a first leg 40 for being received in the holes 34 and 35, and a second leg 42 which can be rotated about the axis of the first leg 40 and positioned in the hook-shaped keeper 44. Of course, when the second leg 42 is seated in the keeper 44 axial movement of the first leg 40 of the pin 38 is prohibited, thereby releasably locking the pin 38 in the holes 34 and 36.

The neck member 22 is also provided with means for releasably engaging a toy tractor 24. Whereas various means can be used, in the preferred illustrated embodiment a downwardly extending mounting pin 46 is provided on the bottom surface 48 of the neck member 22 which is pivotally received in a corresponding hole (not shown) in the tractor 24.

Figure 2:
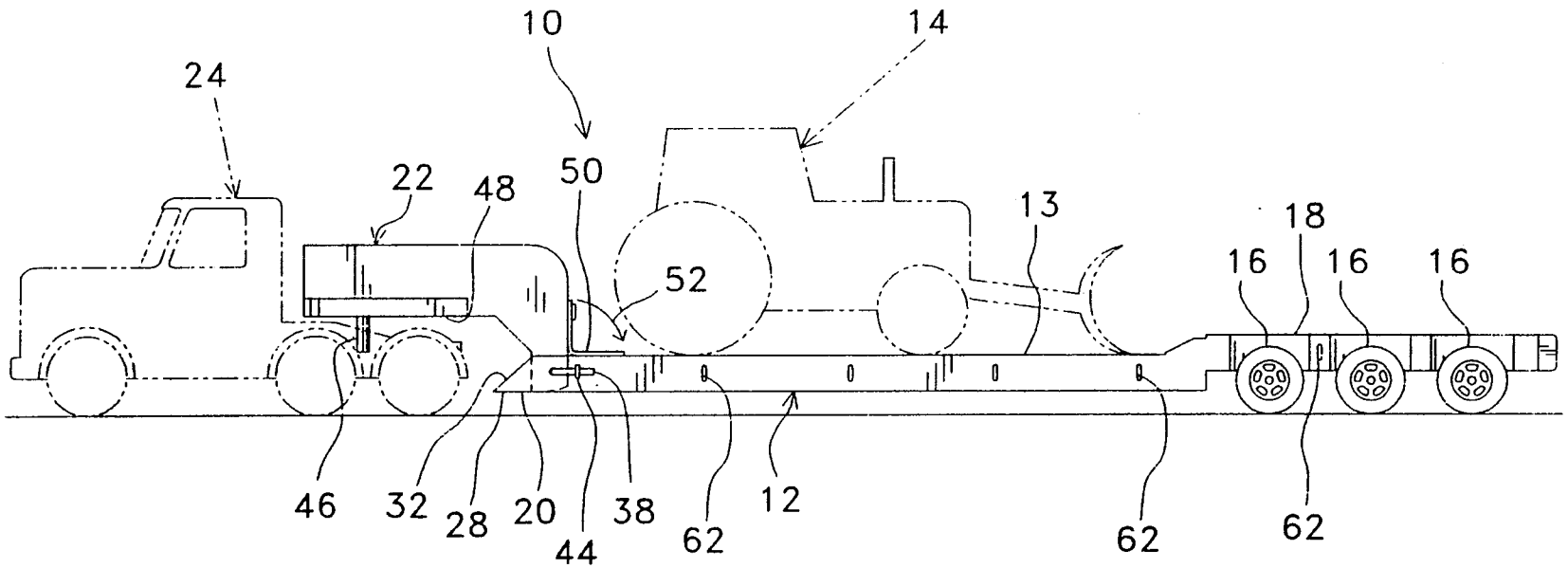
FIG. 2 illustrates a side elevation view of a toy trailer of the present invention.
Figure 3:
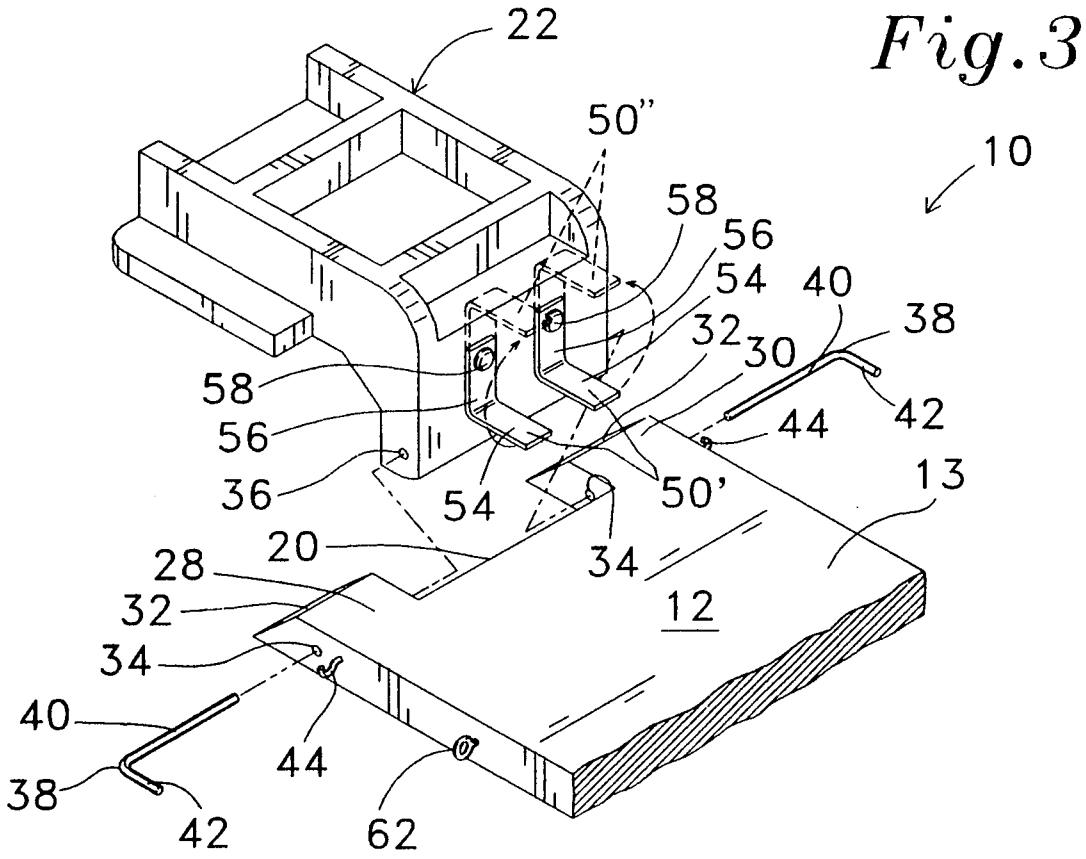
FIG. 3 illustrates a partial perspective view of a toy trailer of the present invention.
Figure 5:
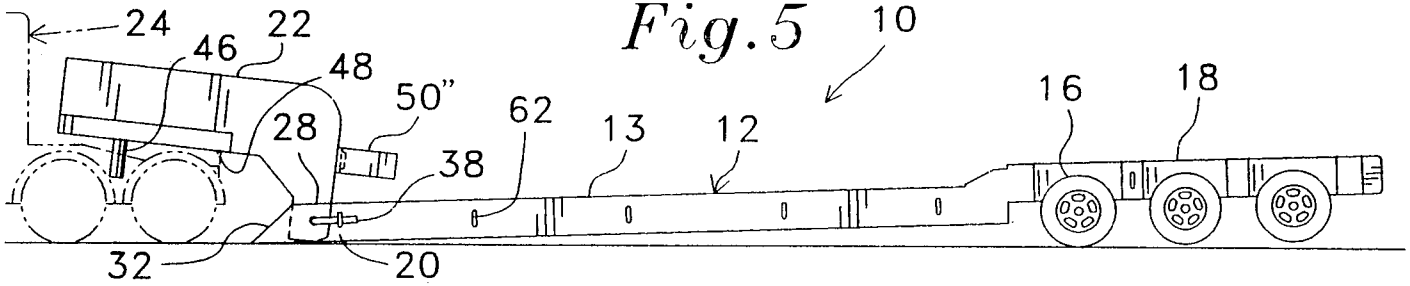
FIG. 5 illustrates a partial side elevation view of a toy trailer of the present invention.

The neck member 22 further includes trailer bed leveling means for maintaining the bed portion 12 of the trailer 10 in a substantially level position relative to the supporting travel surface notwithstanding the pivotal coupling of the neck member 22 to the bed portion 12. In the preferred embodiment such leveling means includes one or more stop members 50 mounted on the rearward end of the neck member 22. The stop members 50 are positioned so as to be disposed above the cargo supporting surface 13, and, as illustrated in FIG. 3, are movable from an engaged position 50' to a disengaged position 50''. As best illustrated in FIG. 2, in the engaged position the stop members 50 engage the cargo supporting surface 13, terminating the pivoting of the neck member 22 with respect to the bed portion 12 in the direction of arrow 52, when such surface 13 is substantially level with the supporting travel surface. As illustrated in FIG. 5, in the disengaged position the stop members 50 are displaced from the load supporting surface 13 so as to allow the neck member 22 to pivot with respect to the bed portion 12 in the direction of arrow 52, thereby allowing the front end portion 20 of the bed portion 12 to be lowered to the ground surface.

In the preferred illustrated embodiment, each of the stop members 50 defines an L-shaped member including a leveling plate 54 for engaging the bed portion 12 of the trailer when the stop members 50 are in an engaged position. Each of the stop members 50 also includes a securing plate 56 pivotally secured to the neck member 22 with suitable fastening means, such as the pivot pins 58, such that the leveling plates 54 can be selectively moved to a disengaged position. It will, however, be recognized that the pivotal mounting of the stop members 50 represents only one suitable means for mounting the stop members 50 such that they are movable from an engaged position to a disengaged position.

Figure 4:
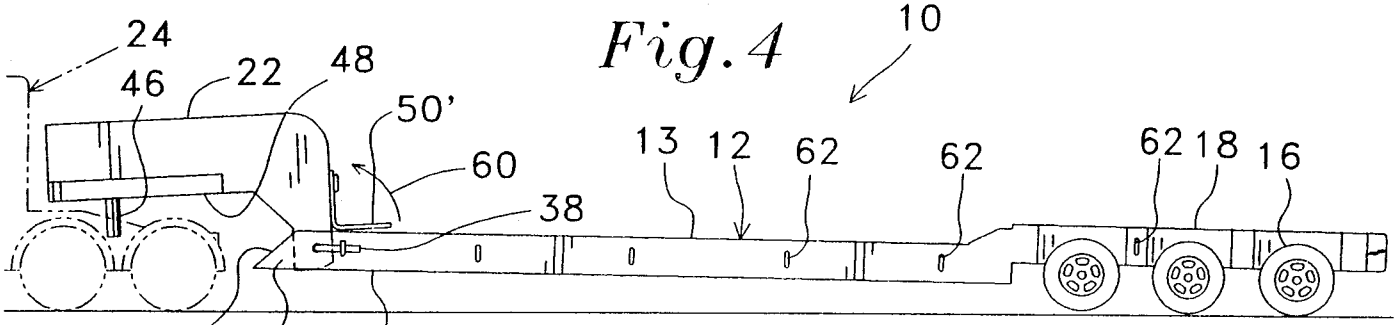
FIG. 4 illustrates a partial side elevation view of a toy trailer of the present invention.

From the above it will be understood that when simulating the loading of a vehicle onto the trailer 10 the user pivots the stop members 50 from the engaged position to the disengaged position allowing the front end portion 20 of the bed portion 12 to be lowered to the supporting travel surface. As illustrated in FIG. 4, this generally requires the slight pivoting of the neck member 22 relative to the bed portion 12 in the direction of arrow 60 to allow the leveling plates 54 to clear the load supporting surface 13 as the stop members 50 are pivoted.

Figure 6:
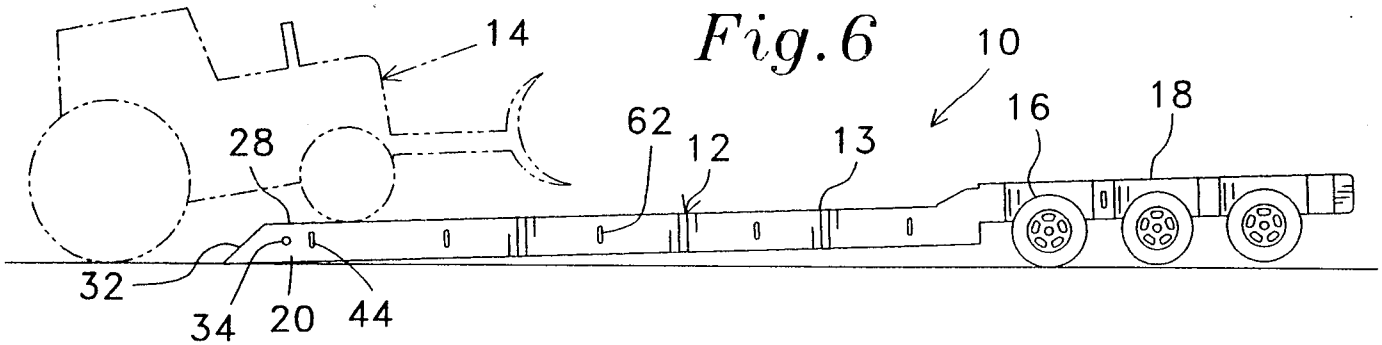
FIG. 6 illustrates a side elevation view of the bed portion of a toy trailer of the present invention.

With the front end portion 20 resting on the supporting ground surface as illustrated in FIG. 5, the securing pins 38 are removed from the holes 34 and 35, there by freeing the neck member 22 from the bed portion 12 and allowing the neck member 22 to be moved such that it does not obstruct access to the ramp sections 28 and 30 and the cargo supporting surface 13. The toy vehicle to be loaded can then be moved up the ramp sections 28 and 30 and onto the cargo supporting surface 13 as illustrated in FIG. 6.

The toy vehicle having been positioned on the load supporting surface, the neck member 22 is positioned between the ramp sections 28 and 30, and the securing pins 38 are reinserted into the holes 34 and 36 to once again secure the neck member 22 to the bed portion 12. Upward lift is then be applied to the front end portion 20 of the bed portion 1 and/or the rear portion of the neck member 22 to reorient the cargo supporting surface 13 to a level position. The stop members 50 are then moved to their engaged positions to maintain such level position, thereby readying the trailer for travel.

It will also be noted that in the preferred embodiment the bed portion 12 of the trailer 10 is provided with a plurality of fasteners or dogs 62 for receiving and securing string or chain (not shown) used to secure the toy vehicle or other cargo being carried on the trailer 10.

In light of the above it will be recognized that the present invention provides a toy trailer for being releasably connected to a toy truck or tractor which depicts, and simulates the functioning of, a "low boy break neck" trailer. Notwithstanding the accuracy of the simulated appearance and function, the trailer can be readily operated by even a preschool child. For older children, or even adults, the trailer can be used in conjunction with a remotely controlled tractor to add realism to the simulation.

However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A toy trailer for releasably engaging and being pulled by a child behind a toy vehicle, and for being supported on and moved over a selected travel surface, said toy trailer being readily operable by said child, wherein said toy trailer comprises:

a bed portion defining an upper cargo supporting surface, and defining a front end portion provided with ramp means and a rear end portion, said bed portion being provided at its rear end portion with at least a pair of oppositely disposed wheel members;

a neck member for releasably coupling said bed portion to said toy vehicle, said neck member having a front end portion provided with means for releasably engaging said toy vehicle, said means being readily operable by said child, and a rear portion for releasably engaging said front end portion of said bed portion, whereby said neck member can be selectively readily disconnected by said child from said front end portion of said bed portion, said neck member also having a rearward end; and stop means for selectively restricting pivoting of said bed portion with respect to said neck member so as to selectively maintain said front end portion of said bed portion in a raised position, wherein said stop means includes at least one stop member movably mounted on said rearward end of said neck member so as to be disposed above said cargo supporting surface, said stop member having a leveling plate for engaging said bed portion and a securing plate pivotally connected to said rearward end of said neck member, said stop member being readily movable by said child from an engaged position wherein said leveling plate engages said front end portion of said bed portion so as to maintain said front end portion of said bed portion in said raised position, to a disengaged position wherein said stop member is displaced from said front end of said bed portion to facilitate lowering by said child of said front end portion of said bed portion to said travel surface.

2. The toy trailer of claim 1 wherein said neck member is pivotally secured to said front end portion of said bed portion, whereby said neck member can selectively pivot with resect to said front end portion of said bed portion to allow said front end portion of said bed portion to be readily pivoted by said child from said raised positioned wherein said upper cargo supporting surface is substantially parallel to said selected travel surface to a lowered position wherein said front end portion of said bed portion engages said travel surface.

3. The toy trailer of claim 2 wherein said front end portion of said bed portion is provided with a pair of forwardly extending ramp sections between which said rear portion of said neck member is selectively readily positioned by said child, each said forwardly extending ramp section being provided with a substantially horizontal hole therethrough, said rear portion of said neck member being provided with a pair of oppositely disposed further holes registering with said substantially horizontal holes in said forwardly extending ramp sections as said neck member is positioned between said forwardly extending ramp sections.

4. The toy trailer of claim 3 wherein said toy trailer further comprises:

at least one pivot pin readily removeable by said child for being releasably received in said substantially horizontal holes in said forwardly extending ramp sections and said further holes in said neck member, whereby said neck member is releasably and pivotally secured to said front end portion of said bed portion; and at least one hook shaped keeper disposed on said forwardly extending ramp section in close proximity with said substantially horizontal holes in said forwardly extending ramp section.

5. The toy trailer of claim 4 wherein each said pivot pin has a first leg for being received in said substantially horizontal holes in said forwardly extending ramp sections and said further holes in said neck member and a second leg which can be readily rotated by said child about axis of said first leg and readily positioned in said hook-shaped keeper by said child, whereby axial movement of said first leg of said pivot pin is prohibited, thereby releasably locking said pivot pin in said substantially horizontal holes in said forwardly extending ramp sections and said further holes in said neck member.

6. A tory trailer for releasably engaging and being pulled by a child behind a toy vehicle, and for being supported on and moved over a selected travel surface, said toy trailer being readily operable by said child comprising:

a bed portion defining an upper cargo supporting surface, and defining a front end portion and a rear end portion, said bed portion being provided at its rear end portion with at least a pair of oppositely disposed wheel members, said front end portion of said bed portion being provided with a pair of forwardly extending ramp sections, each said forwardly extending ramp section being provided with a substantially horizontal hole therethrough;

a neck member for releasably coupling said bed portion to said toy vehicle, said neck member having a front end portion provided with means for releasably engaging said toy vehicle, said means being readily operable by said child, and a rear portion for being readily positioned by said child between said forwardly extending ramp sections of said bed portion and for releasably engaging said front end portion of said bed portion, said rear portion of said neck member being provided with a pair of oppositely disposed further holes registering with said substantially horizontal holes in said forwardly extending ramp sections as said neck member is positioned between said forwardly extending ramp sections, said neck member also having a rearward end;

at least one hook shaped keeper disposed on said forwardly extending ramp section in close proximity with each said substantially horizontal hole in each said forwardly extending ramp section;

at least one pivot pin readily removeable by said child for being releasably received in said substantially horizontal holes in said forwardly extending ramp sections and in said further holes in said neck member, said pivot pin having a first leg for being received in said substantially horizontal holes in said forwardly extending ramp sections and said further holes in said neck member and a second leg which can be readily rotated by said child about axis of said first leg and readily positioned in said hook-shaped keeper by said child, whereby axial movement of said first leg of said pivot pin is prohibited, thereby releasably locking said pivot pin in said substantially horizontal holes in said forwardly extending ramp sections and said further holes in said neck member, whereby said neck member is releasably and pivotally secured to said front end portion of said bed portion, and whereby said neck member can selectively pivot with respect to said front end portion of said bed portion to allow said front end portion of said bed portion to be readily pivoted by said child from a raised position wherein said cargo supporting surface is substantially parallel to said travel surface to a lowered position wherein said front end portion of said bed portion engages said travel surface; and stop means for selectively restricting pivoting of said bed portion with respect to said neck member so as to selectively maintain said front end portion of said bed portion in said raised position, said stop means including at least one stop member pivotally mounted on said rearward end of said neck member so as to be disposed above said cargo supporting surface, said stop member having a leveling plate for engaging said bed portion and a securing plate pivotally connected to said rearward end of said neck member, said stop member being readily pivotable by said child from an engaged position, wherein said leveling plate engages said front end portion of said bed portion in said raised position, to a disengaged position wherein said stop member is displaced from said front end of said bed portion to facilitate lowering of said front end portion of said bed portion to said travel surface by said child.

7. The toy trailer of claim 6 wherein said at least one stop member is substantially L-shaped.

* * * * *